US008152395B2

(12) United States Patent
Liu

(10) Patent No.: US 8,152,395 B2
(45) Date of Patent: Apr. 10, 2012

(54) PEN WITH ADJUSTABLE HOLDING STRUCTURE

(76) Inventor: Bao-Shen Liu, Taipei County (TW)

( * ) Notice: Subject to any disclaimer, the term of this patent is extended or adjusted under 35 U.S.C. 154(b) by 776 days.

(21) Appl. No.: 12/237,255

(22) Filed: Sep. 24, 2008

(65) Prior Publication Data

US 2010/0074669 A1 Mar. 25, 2010

(51) Int. Cl.
*A46B 5/02* (2006.01)

(52) U.S. Cl. ..... 401/6; 401/21; 401/88; 401/99

(58) Field of Classification Search ..... 401/6, 16, 401/19, 21, 99, 88, 148
See application file for complete search history.

(56) References Cited

U.S. PATENT DOCUMENTS 5,143,463 A * 9/1992 Pozil et al. ..... 401/6
5,626,430 A * 5/1997 Bistrack ..... 401/6
6,036,385 A * 3/2000 Bistrack ..... 401/6
7,128,484 B2 * 10/2006 Schulken ..... 401/6
7,316,516 B2 * 1/2008 Regala ..... 401/6

* cited by examiner

*Primary Examiner* — Steven J Ganey
(74) *Attorney, Agent, or Firm* — WPAT, P.C.; Anthony King

(57) ABSTRACT

A pen with adjustable holding structure is essentially for the user to write with his/her specified finger to lean against a stop protuberance. The pen has a penholder with a writing end formed at its front tip for writing. The stop protuberance is provided ahead of the holding position, and an adjustable holding part is formed on the penholder behind the stop protuberance. With this structure, when manipulating the pen, the user may select one of five fingers as a specified one to lean against the stop protuberance to settle thereat. The adjustable holding part is bendable at random according to the user's manipulation habit so as to lead the specified finger to lean against the best position on the stop protuberance to perform writing with the pen.

17 Claims, 21 Drawing Sheets

PEN WITH ADJUSTABLE HOLDING STRUCTURE

BACKGROUND OF THE INVENTION

1. Field of the invention

The present invention relates to a pen with adjustable holding structure, and in particular, to a pen which is convenient to write by leaning the specified finger to "lean" against the most comfortable place for writing. The pen is particularly suitable for writing for a long time, or for a person who has handicapped fingers necessary for avoiding fatigue or injury to the hand.

2. Description of the Prior Art

Well-known pens like fountain pen, ball pen, pencil (hard type), and brush (soft type for both writing and painting), are all used for a common purpose to make record by holding the pen in different ways.

FIG. 1 is a perspective view showing a posture of holding a pen. The most common cylindrical penholder "a" which fails to provide a place on its surface for exerting the force of a finger "g" causing the user to almost "grasp" the cylindrical penholder "a" so as to surely hold the penholder when writing such that the finger "g" is unable to be liberated from an intensive applying force during writing. The finger "g", which being constantly exerting with force, is apt to suffer from blisters or dull aching in "N", and possibly extending farther to the whole palm "h" as shown area "M" of FIG. 6. Especially to a child whose palm "h" is not yet grown, the finger "g" will usually slip down to the position of pen nib "b" as being unable to reliably hold the cylindrical penholder (see FIG. 2). As a result, the action of writing which is supposed to be smooth becomes so stiff like carving an object. And to the worst, the head of the child will incline closer to the desk as the sight is shaded by its own hand thereby gradually affecting the eyesight or even the normal growth of backbone.

Meanwhile, as shown in FIG. 3, other than the cylindrical pen, there is another one in a triangular prismatic shape "C" on the market that can quickly help the user to set the finger "g" at a proper location, but is still unable to solve the problems of "grasping penholder" or others as described above. The triangular penholder "c" is integrated into one piece and enclosed with a section of rubber sleeve "d" over the penholder "e" so as to provide an extra friction for enhancing the holding force thereby avoiding the slipping of the finger "g" during writing. However, as shown in FIG. 4, notwithstanding the thicker rubber sleeve "d" provides a comfortable feeling at the beginning of writing by grasping the penholder, the applied force "F" by the finger "g" will be gradually transmitted to the hard penholder "e" overlaid by the rubber sleeved so as to oppress the finger "g". Besides, as shown in FIG. 5, in some cases, the lower fringe "f" of the rubber sleeved is formed into a flange to restrain slipping down of the finger "g". Afterall, there is still no contribution to cure the writer's dull aching or blisters after grasping the penholder a while.

Base on these noticeable defects of the conventional pen structures, an improvement is seriously required.

SUMMARY OF THE INVENTION

Accordingly, it is an object of the present invention to provide a pen with adjustable holding structure which allows the user's fingers to lean against certain places when writing, and particularly suitable for the user with handicapped finger or fingers to lean against particularly prepared places during writing.

It is another object of the present invention to provide a pen with adjustable holding structure which is structured with a stop protuberance accompanied with a deformable rubber sleeve so as to adjustably bend the pen according to the user's manipulation habit and leading the user's fingers to set at the proper position on the penholder for writing.

It is still another object of the present invention to provide a pen with adjustable holding structure which can be fabricated on the existing production line by only modifying a minor condition to fulfill the aim of mass production.

To achieve the aforesaid objects, the penholder of the present invention has a writing end on its front tip, a stop protuberance and adjustable holding part are provided for the penholder. The stop protuberance is located ahead of the holding part such that the user's specified finger is able to lean against the stop protuberance when holding the penholder. The adjustable holding part, which being provided on the penholder behind the stop protuberance, is adjustably bent according to the user's manipulation habit thereby guiding the user's fingers to set at the best position for writing. With this scheme, when the user manipulates the pen, his/her specified finger is brought to lean against the stop protuberance so as to adjustably bend the holding part according to the user's manipulation habit thereby aiding the user to write. In case the user is a person with handicapped fingers, a finger which is suitable for writing can be selected to lean against an optimal place when writing. This pen structure is particularly suitable for a person who has handicapped fingers, or developmentally delayed children to use.

BRIEF DESCRIPTION OF THE DRAWINGS

FIG. 38 is a perspective view wherein the pen cap is put on.

Figure 1:
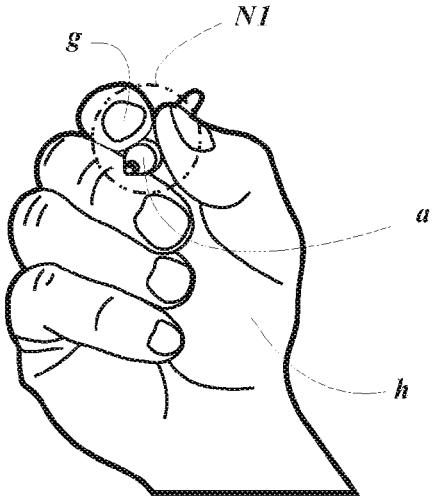
FIG. 1 is a schematic view showing the holding posture of a conventional cylindrical pen.
Figure 2:
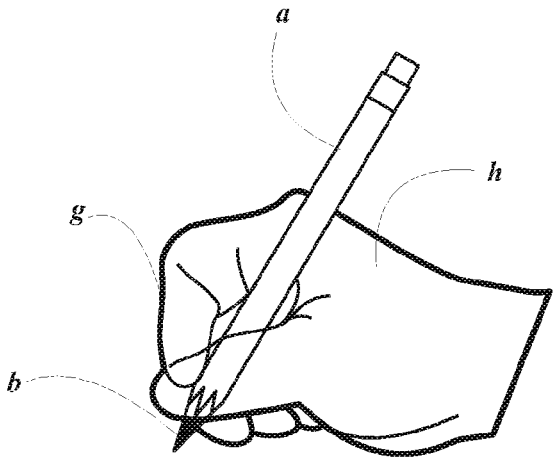
FIG. 2 is a side view showing the holding posture of a conventional cylindrical pen.
Figure 3:
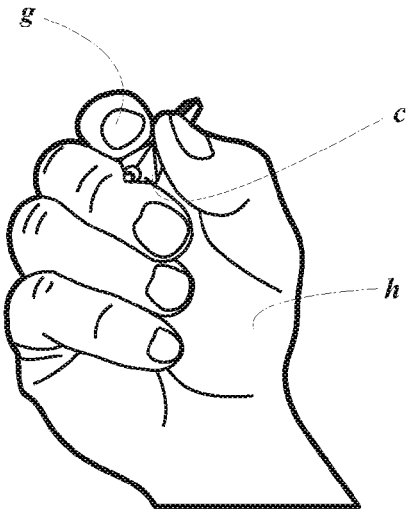
FIG. 3 is a schematic view showing the holding posture of a conventional triangular prismatic pen.
Figure 4:
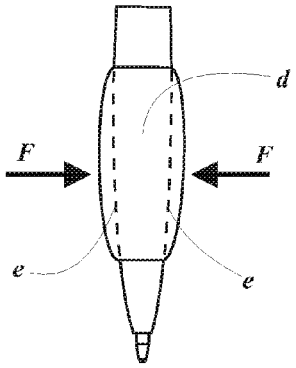
FIG. 4 is a schematic view of a rubber sleeve for a conventional pen.
Figure 5:
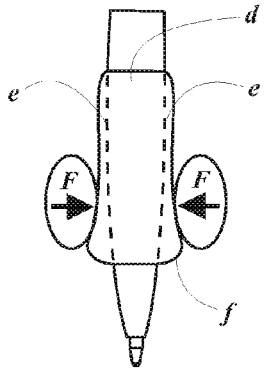
FIG. 5 is a schematic view showing the direction of force exerted to the rubber sleeve in a conventional pen.
Figure 6:
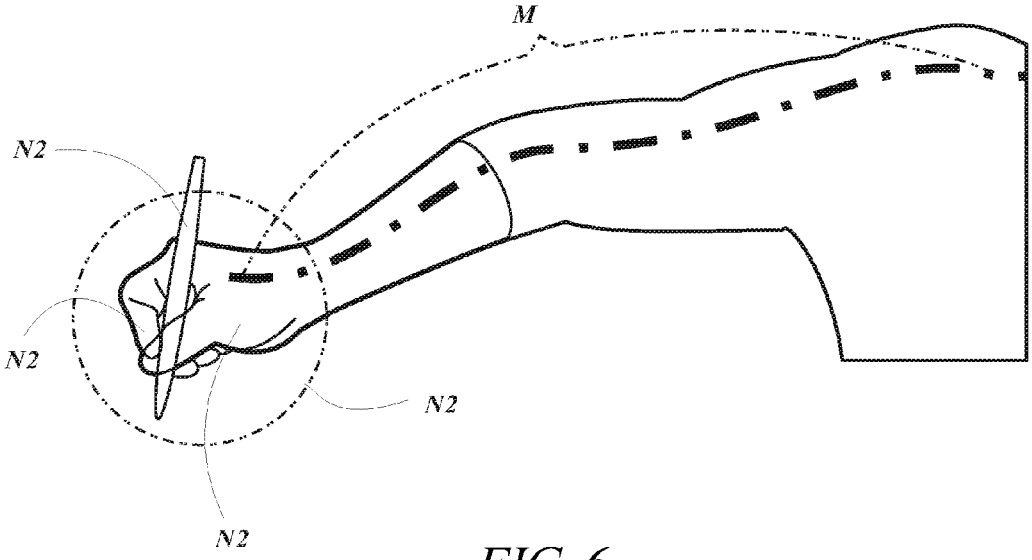
FIG. 6 is an illustrative view showing the possible injurious regions on the user's hand when using a conventional pen.
Figure 7:
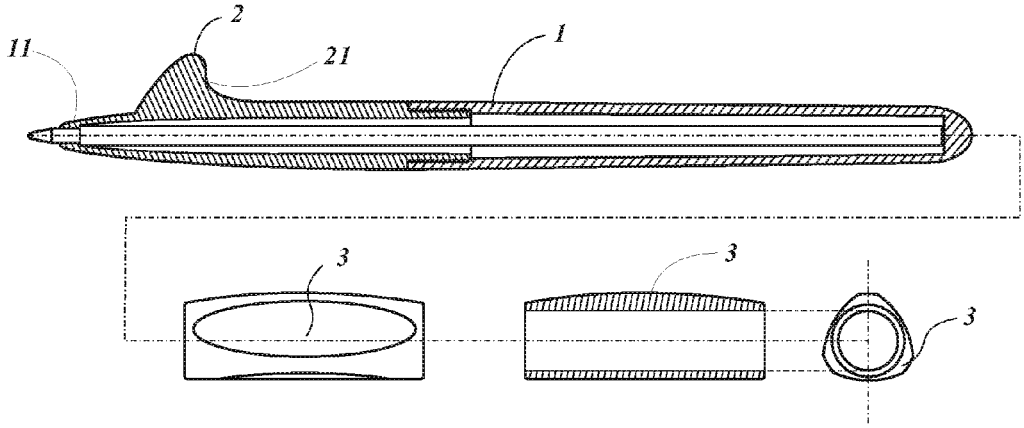
FIG. 7 and FIG. 8 are respectively an exploded view and an assembled view of the present invention.
Figure 8:
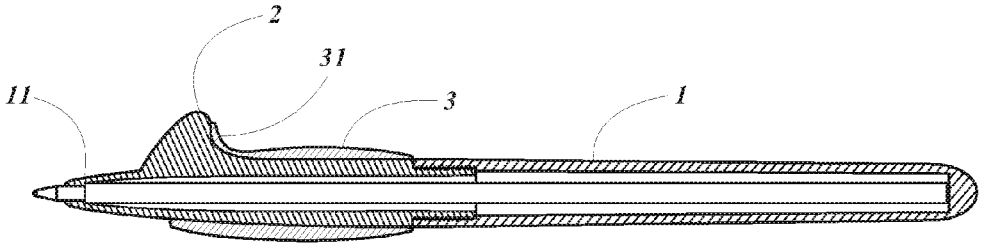
Figure 9:
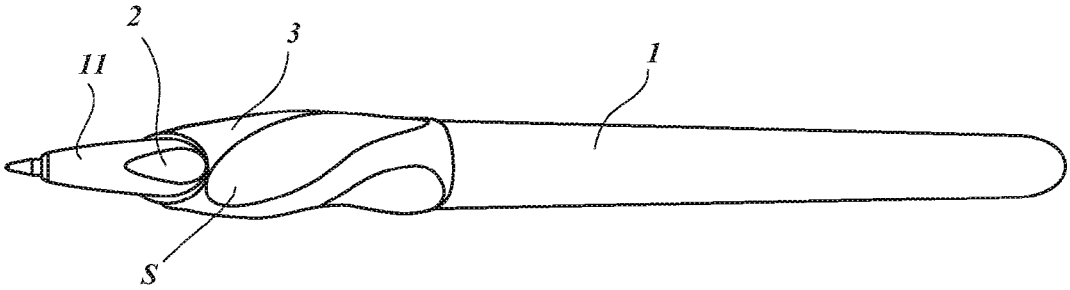
FIG. 9 and FIG. 10 are respectively a schematic view and a manipulation view of the adjustable holding part according to the present invention.
Figure 10:
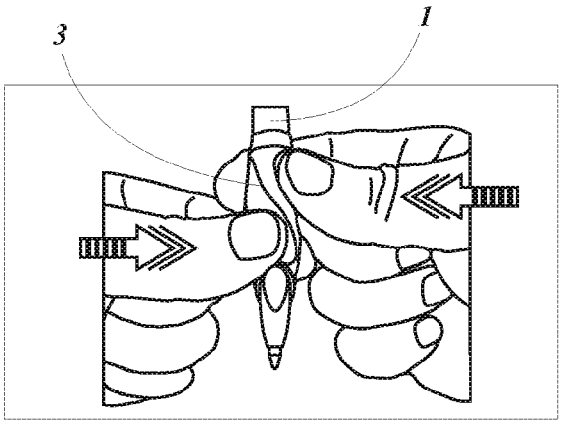
Figure 11:
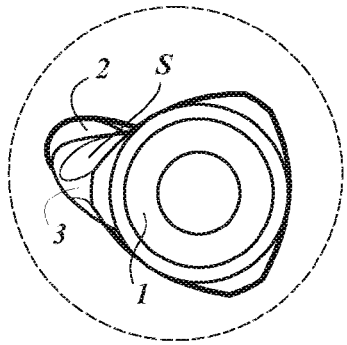
FIG. 11 is a front view of the present invention.

NUMERALS OF THE COMPONENTS a: cylindrical penholder b: pen nib c: triangular prismatic penholder d: rubber sleeve e: penholder f: lower fringe g: finger h: palm i: arm j1,j2: handicap line N1,N2,M: region s: guide end surface F: applied force F1,F2,F3: contact surface L1: general distance L2: shortened distance 1,1*a*: penholder 11,11*a*: Writing end 12: center of writing end 12*a*: movable tube 13*a*: screw thread 14*a*: nipple 2: stop protuberance 21: supporting surface 3: adjustable holding part 31: leant surface of the finger 4: fingers 41: specified finger 42: nail 43: auxiliary positioning finger 5: pen cap 51: slot 52: coupling edge 53: pen hook 6: auxiliary stop protuberance 61: leant surface of the finger 62: slip resistant streaks

DETAILED DESCRIPTION OF THE PREFERRED EMBODIMENT

Referring to FIG. 7 through FIG. 11, the present invention provides a pen for the user to write by leaning a specified finger against a proper location. The pen comprises a penholder 1, a stop protuberance 2, and an adjustable holding part 3. The penholder 1, which is for the user to hold when writing, has a writing end 11 on its front tip. The stop protuberance 2 is formed on the penholder 1 ahead of the holding place so as to allow the user to lean his/her specified finger 41 against it. The adjustable holding part 3 is provided on the penholder 1 behind the stop protuberance 2 liable to bend at random according to the user's manipulation habit (see FIG. 10) thereby leading the user's fingers 4 to rest at the best position.

There is a supporting surface 21 in a flat or slightly recessed accurate shape formed behind the stop protuberance 2 and is capable of varying its shape according to the user's palm so as to assist the user's fingers 4 to lean against the adjustable holding part 3. Especially to a person who has handicapped fingers, the supporting surface 21 may modify its configuration to fit for the individual finger condition so as to meet the user's particular finger condition or manipulation habit. The adjustable holding part 3 has a geometrically polygonal figure bendable in accordance with user's manipulation habit so as to lead the user's fingers 4 to rest at the best position for writing. The adjustable holding part 3 may be in a triangular shape other than polygonal and independently made of a soft material that is convenient to attach to the penholder 1 closely in contact with the stop protuberance 2. The adjustable holding part 3 is squeezed ahead to form a curved leaning surface for the finger 31 on the supporting surface 21 prepared for a specified finger 41 to lean against.

Figure 12:
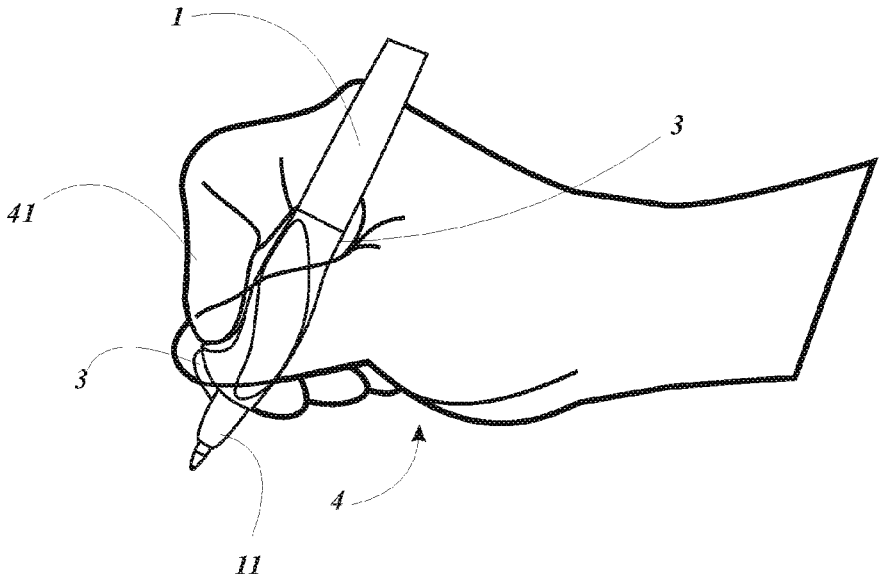
FIG. 12 is a schematic view showing a holding posture of the present invention.
Figure 13A:
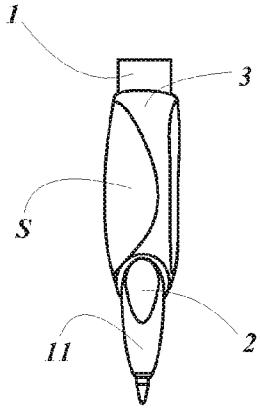
FIG. 13A through FIG. 13C are schematic views showing various adjustment of adjustable holding part according to the present invention.
Figure 13B:
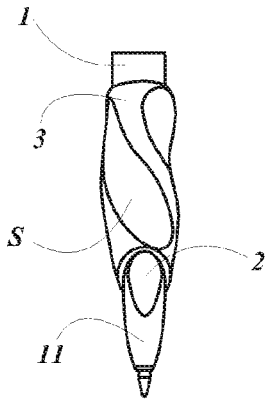
Figure 13C:
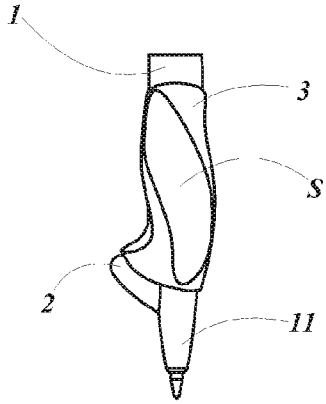
Figure 14:
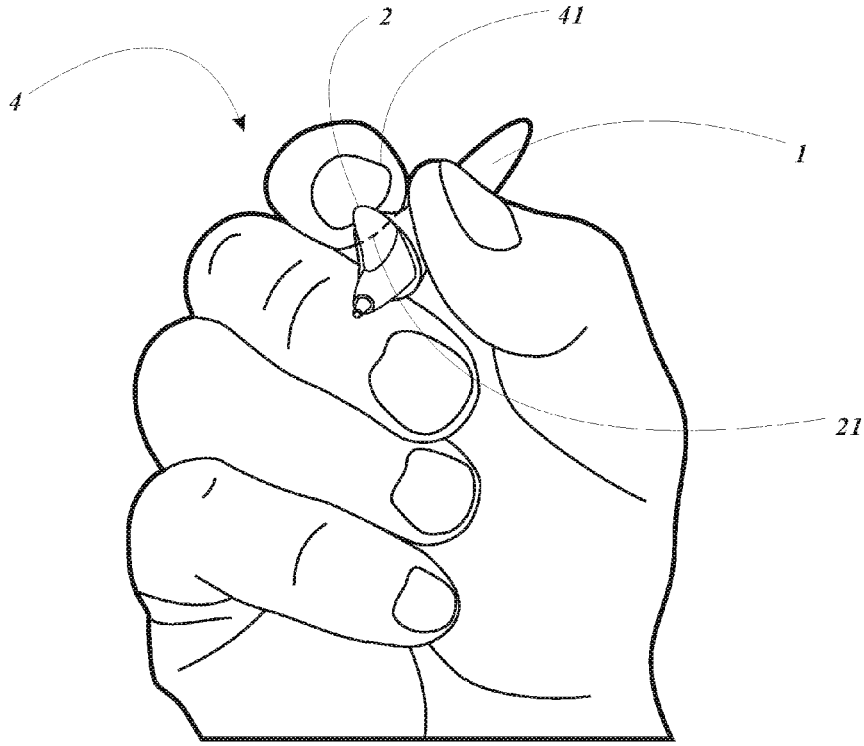
FIG. 14 is a schematic view showing the holding posture of the present invention viewed from another direction.
Figure 15:
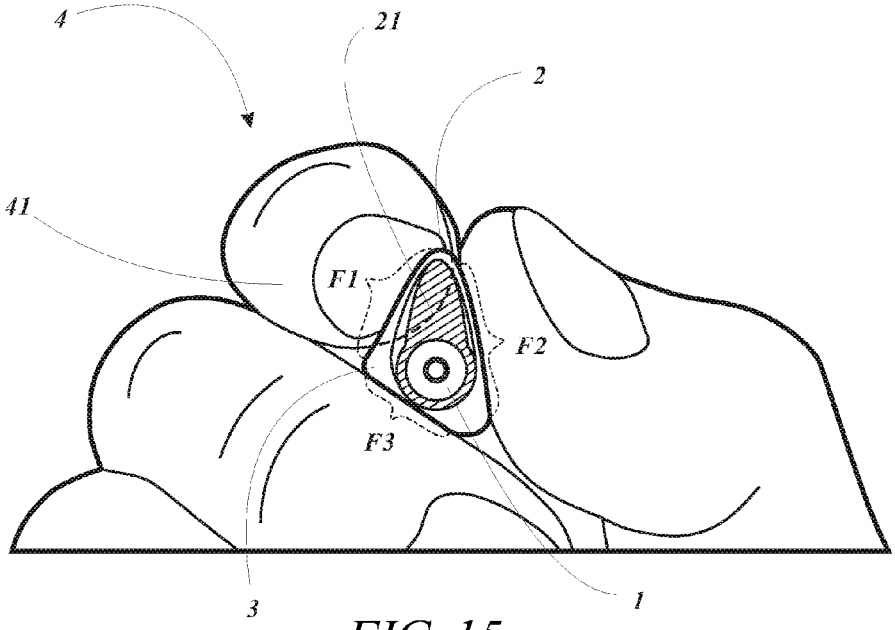
FIG. 15 is a front view showing the adjustable holding part after adjustment according to the present invention.
Figure 16:
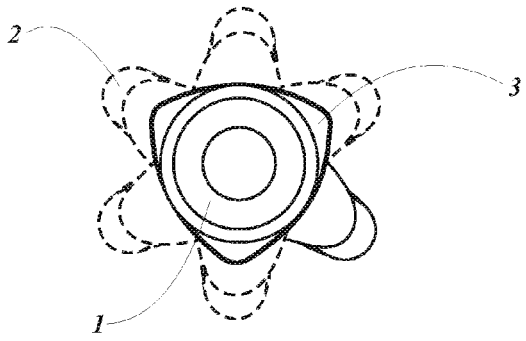
FIG. 16 is a schematic view showing turning state of the adjustable holding part according to the present invention.
Figure 17:
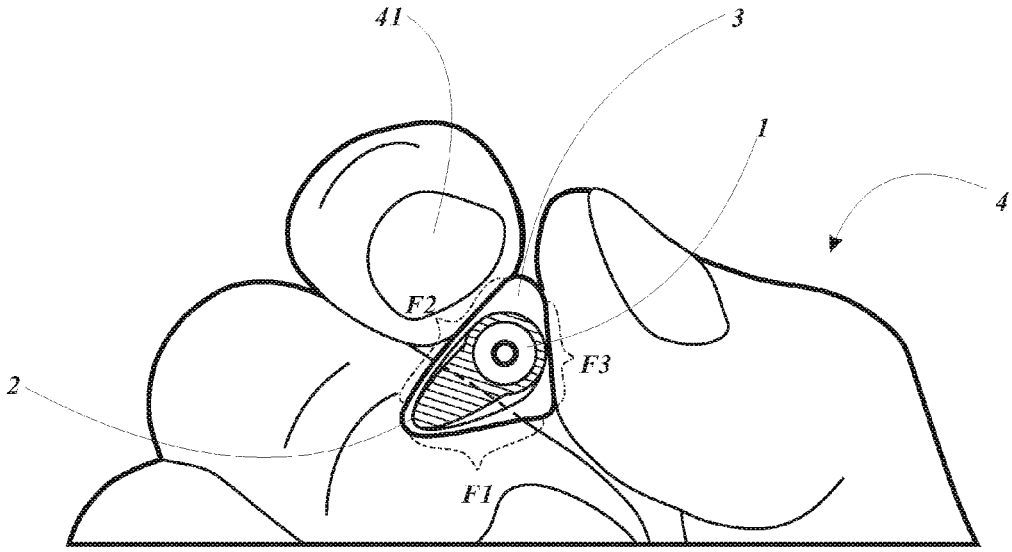
FIG. 17 is another front view showing the adjustable holding part after adjustment according to the present invention.

Referring to FIG. 12 through FIG. 13C, on the adjustable holding part 3, a guide end surface S which being formed into different figures by bending. When the user is holding the penholder 1, the fingers 4 are led to a correct position through the guide end surface S, and the specified finger 41 (the index finger in FIG. 12) is leant against the stop protuberance 2 and is supported there, rest of the fingers 4 are comfortably in contact with the adjustable holding part 3 and positioned there. In this manner, by holding the pen between one downwardly erected specified finger 41 and holding rest of four upwardly erected fingers 4, the penholder 1 may be reliably and comfortably held without slipping off as that may happen to a conventional pen structure.

Referring to FIG. 14 through FIG. 17, the adjustable holding part 3 may rotate around the penholder 1 if necessary so as to hold the penholder 1 in various directions and lean the specified finger 41 on the supporting surface 21, and adjusting the contact area of the finger 41 with the contact surfaces F1, F2 and F3 so that each of the fingers 4 is able to occupy a broader contact area on the contact surfaces F1, F2 and F3 more comfortably.

Figure 18:
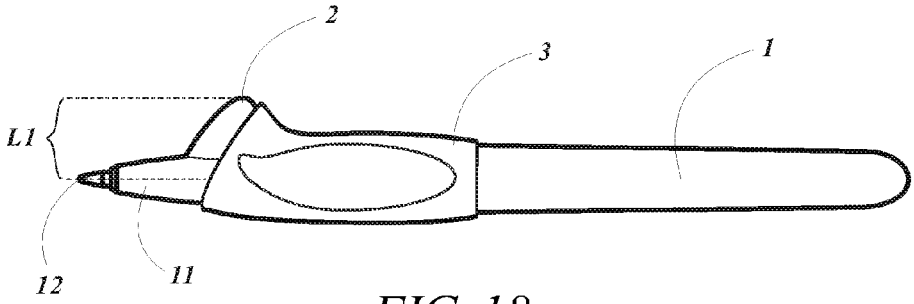
FIG. 18 and FIG. 19 are respectively the schematic views of a stop protuberance formed with normal and reduced height according to the present invention.
Figure 19:
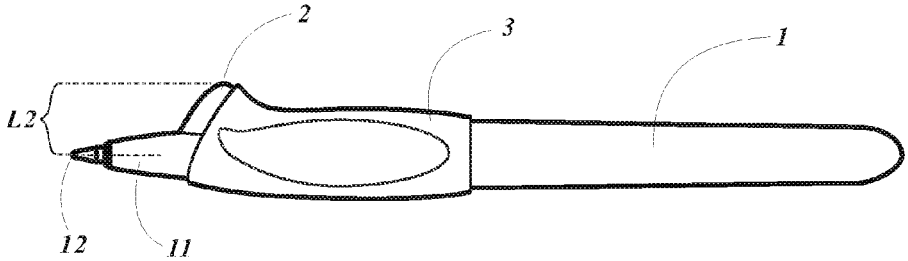
Figure 20:
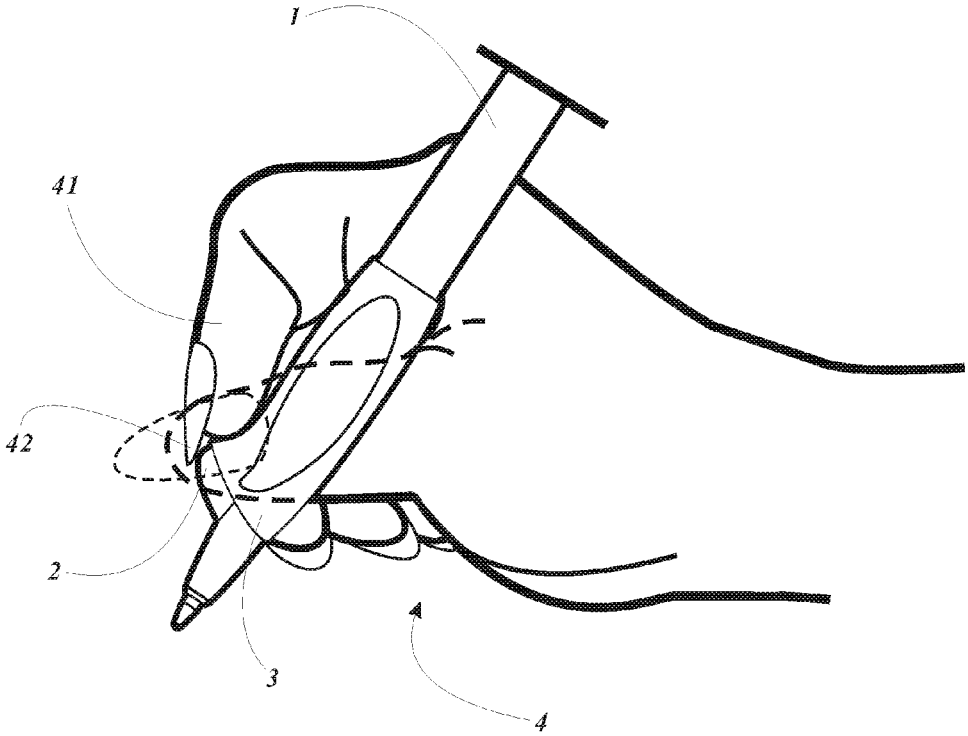
FIG. 20 is a schematic view showing the holding posture on a stop protuberance of reduced height according to the present invention.

Referring to FIG. 18 through FIG. 20, to ensure the "lean" effect of the present invention, the finger nail 42 may result in an obstacle for manipulation. As a result, the distance between the stop protuberance 2 and the center of the writing end 12 may be varied. As shown in FIG. 18, a general distance is L1, but as shown in FIG. 19, this distance is shortened to L2. By adjusting the distance L1 and L2, when the specified finger 41 is leant against the stop protuberance 2, the nail 42 is allowed to lay on the stop protuberance 2 so as to write in a comfortable way (see FIG. 20).

Referring to FIG. 21 and FIG. 22, by varying the way of installing the adjustable holding part 3 as described above, anyone has the choice to his/her own suitable holding manner of using the right or left hand free from limitation.

Figure 21A:
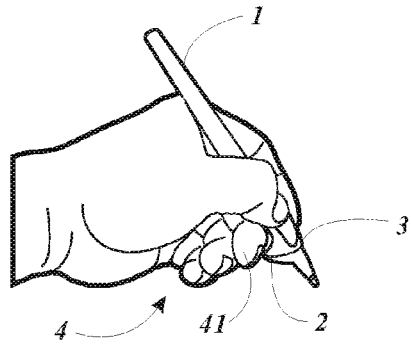
FIG. 21A through FIG. 21E are respective schematic views showing the light hand holding postures on the pen according to the present invention.
Figure 21B:
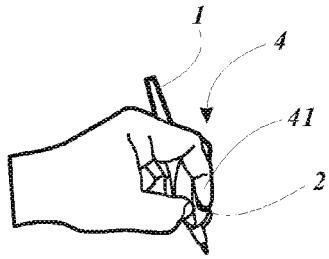
Figure 21C:
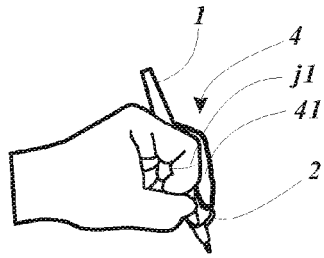
Figure 21D:
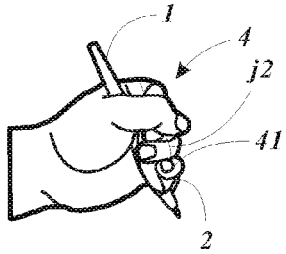
Figure 21E:
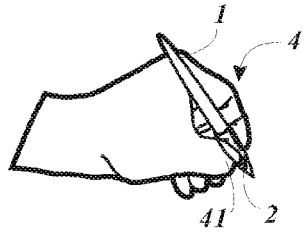
Figure 22A:
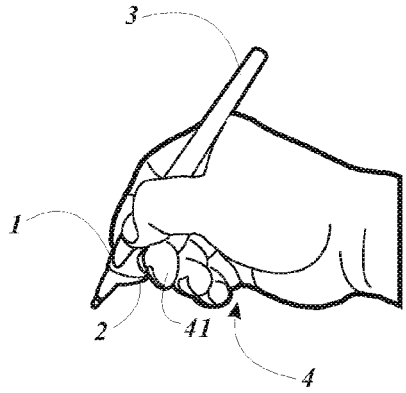
FIG. 22A through FIG. 22E are respective schematic views showing the right hand holding postures on the pen according to the present invention.
Figure 22B:
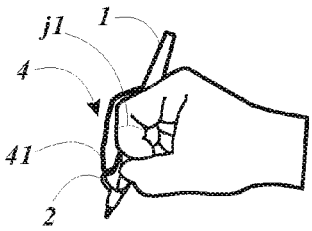
Figure 22C:
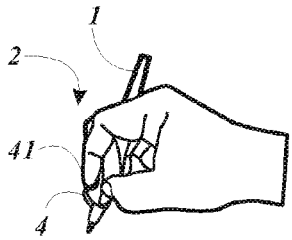
Figure 22D:
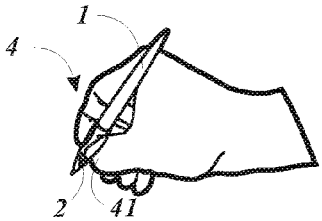
Figure 22E:
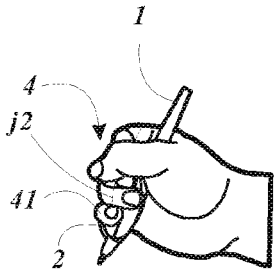
Figure 23:
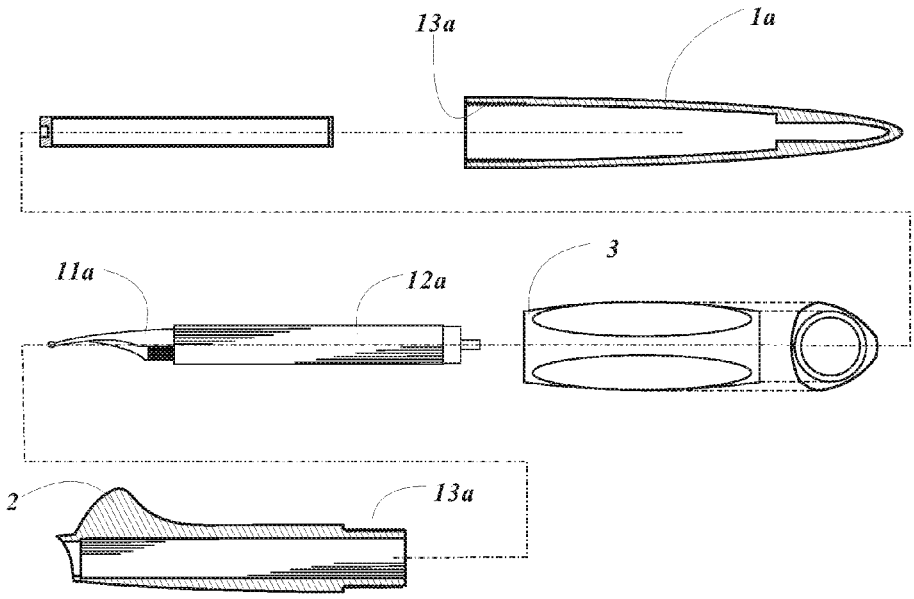
FIG. 23 is an exploded view showing installation of a directional pen according to the present invention.
Figure 24:
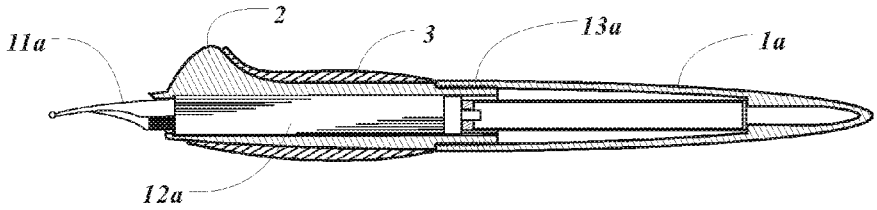
FIG. 24 is an assembly view of FIG. 23.
Figure 25:
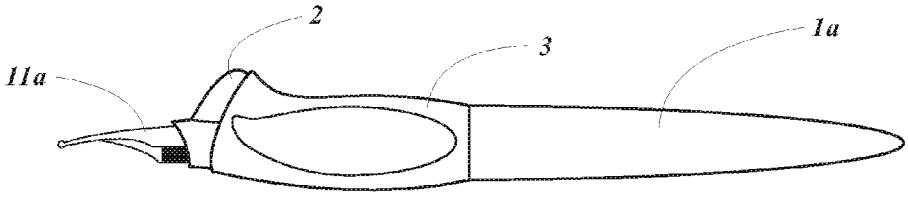
FIG. 25 through FIG. 27 are respectively a side view, a bottom view, and a top view of the structure of a directional pen according to the present invention.
Figure 26:
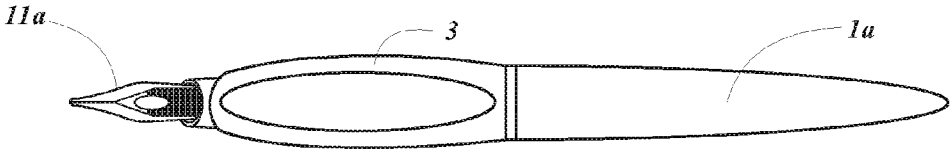
Figure 27:
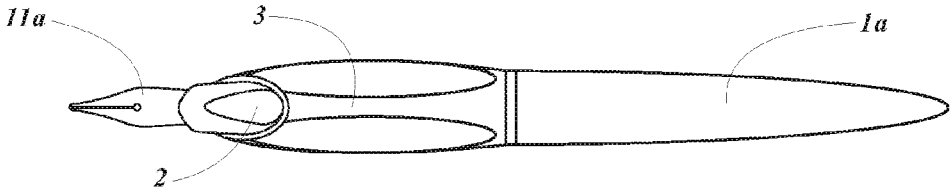
Figure 28:
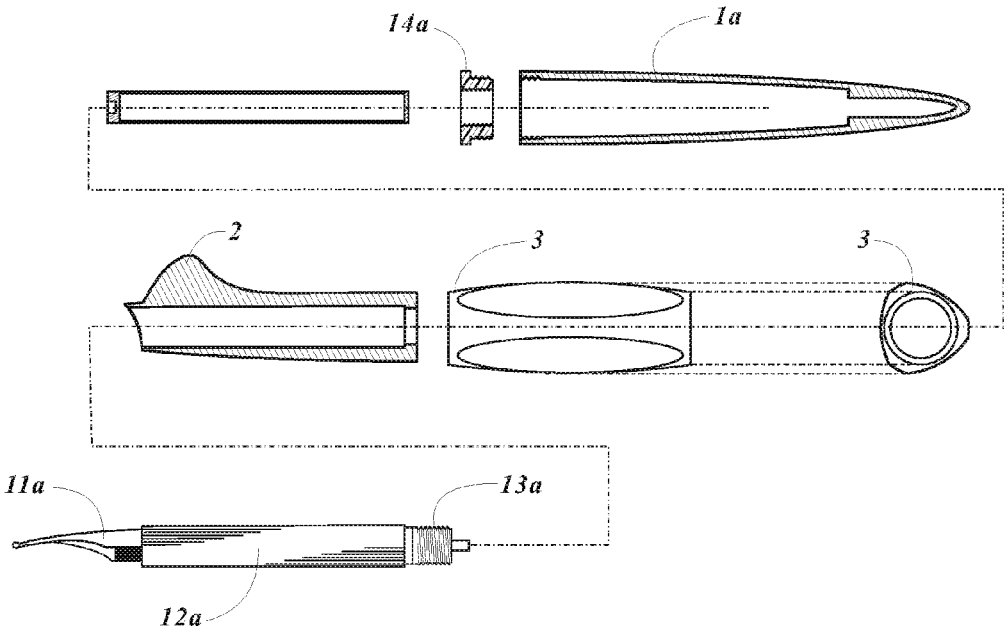
FIG. 28 is an exploded view showing the structure of screw combined movable tube for the directional pen according to the present invention.
Figure 29:
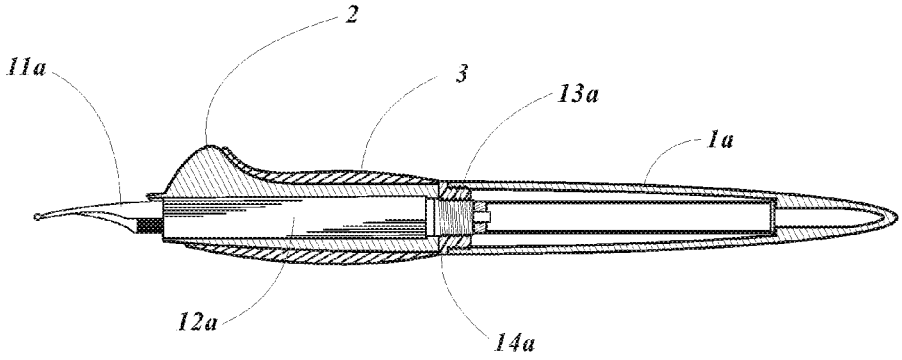
FIG. 29 is an assembly view showing the structure of screw combined movable tube for the directional pen according to the present invention.
Figure 30:
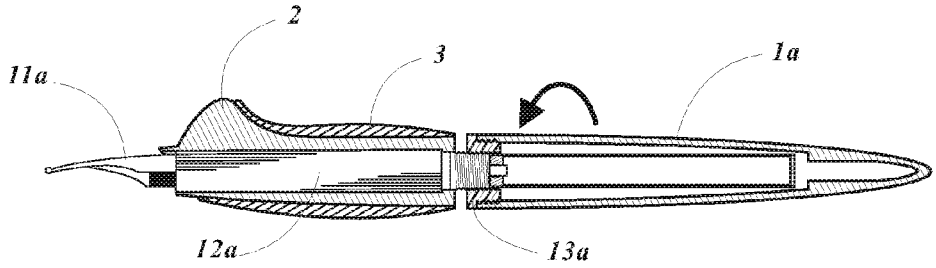
FIG. 30 and FIG. 31 are two sectional views (1) and (2) illustrating the manipulation of the directional pen according to the present invention.
Figure 31:
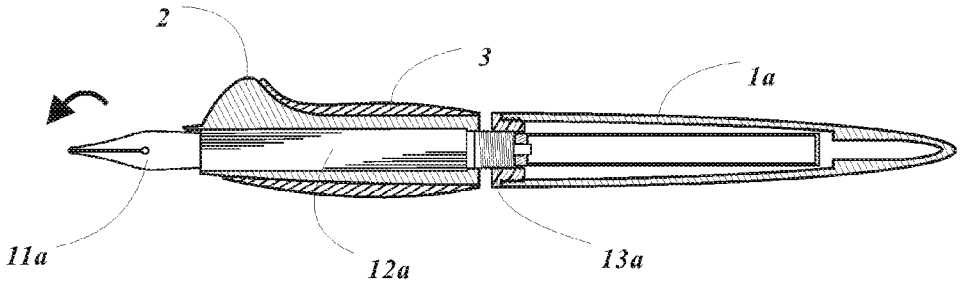
Figure 32:
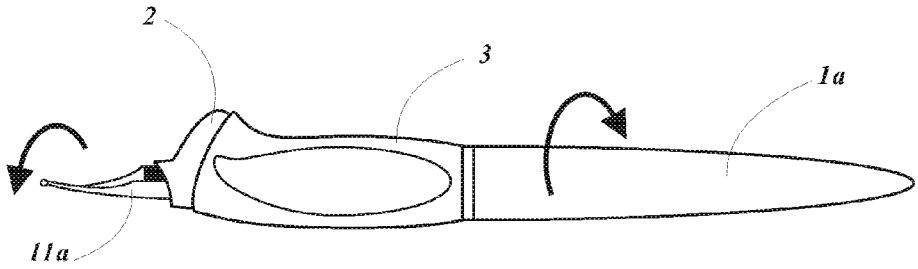
FIG. 32 is a perspective view illustrating the manipulation of the directional pen according to the present invention.
Figure 33:
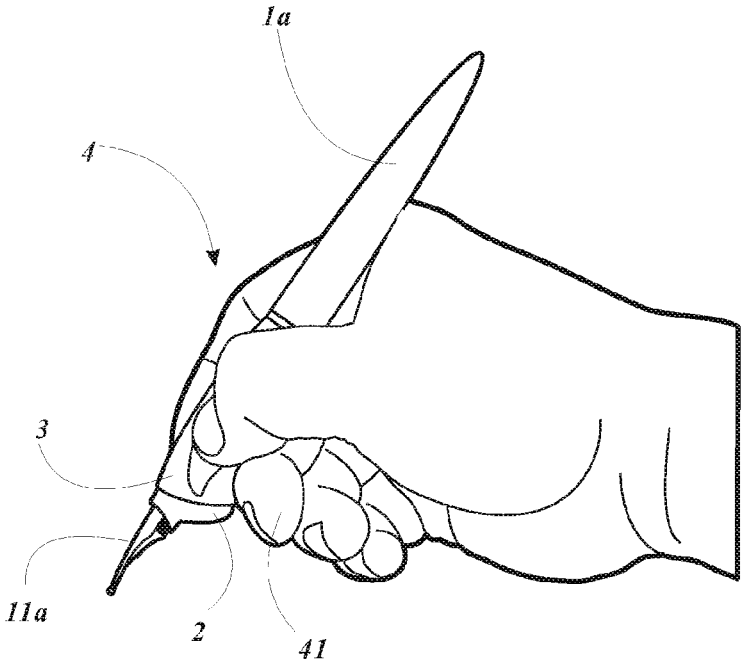
FIG. 33 and FIG. 34 are two perspective views showing the holding posture of the directional pen according to the present invention.
Figure 34:
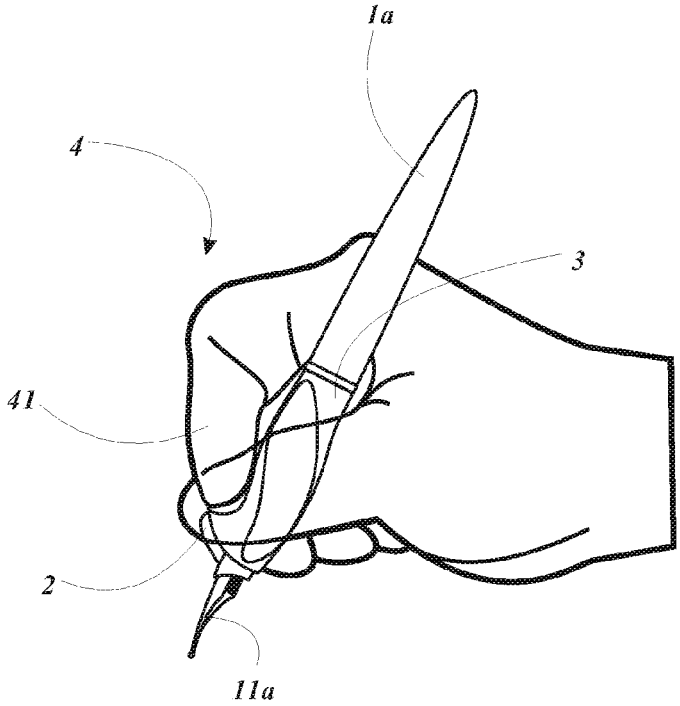
Figure 35:
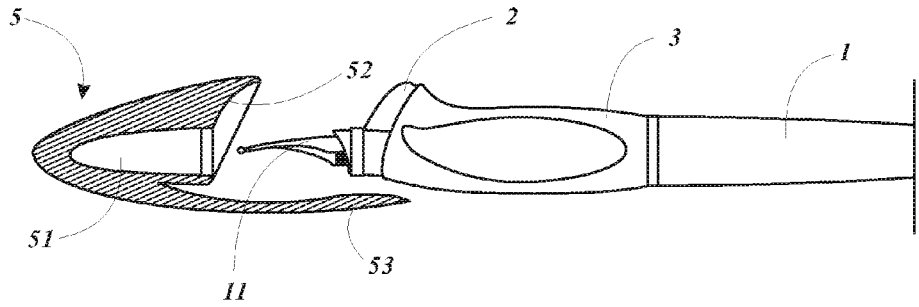
FIG. 35 and FIG. 36 are two sectional views showing the pen cap is taken off (FIG. 35) or put on (FIG. 36).
Figure 36:
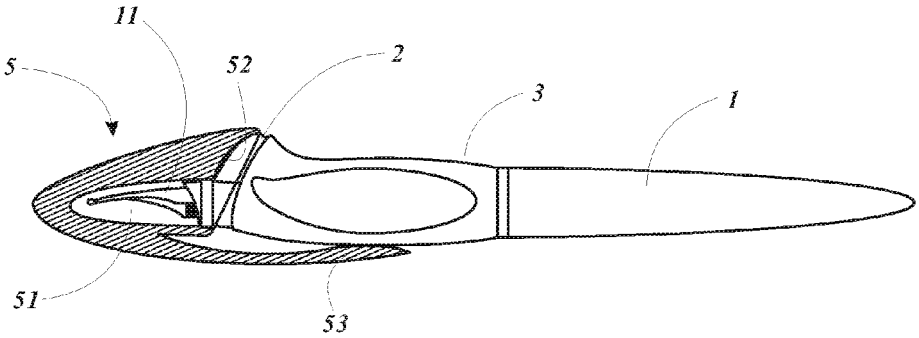
Figure 37:
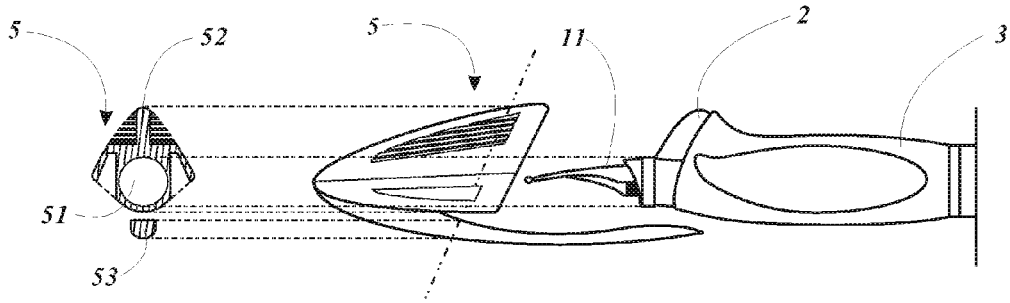
FIG. 37 is a schematic view of the pen cap viewed from the front and the side.
Figure 38:
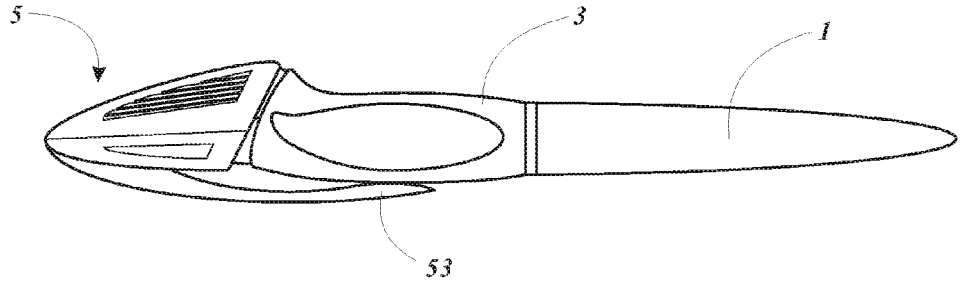
Figure 39:
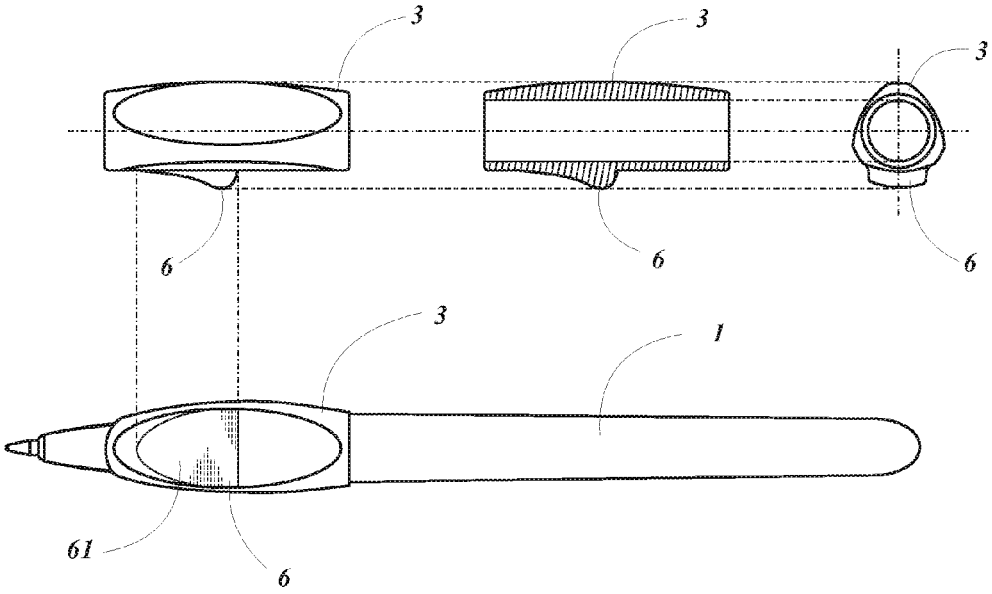
FIG. 39 is an exploded view of the auxiliary stop protuberance formed on the penholder of the present invention.
Figure 40:
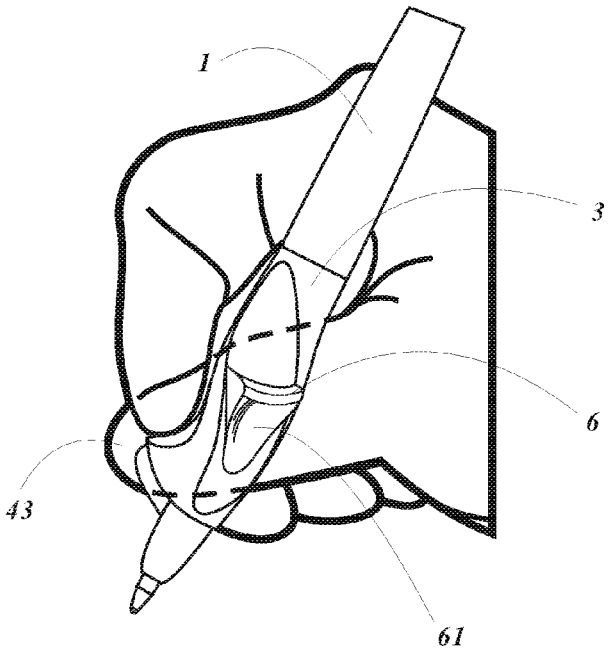
FIG. 40 is a schematic view showing how the user's fingers are holding on the auxiliary stop protuberance.
Figure 41A:
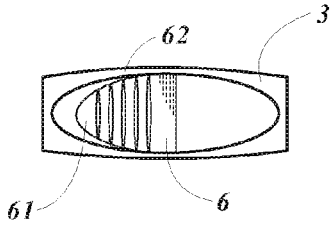
FIG. 41A, FIG. 41B and FIG. 41C are three schematic views showing the three different surface patterns of the auxiliary stop protuberance.
Figure 41B:
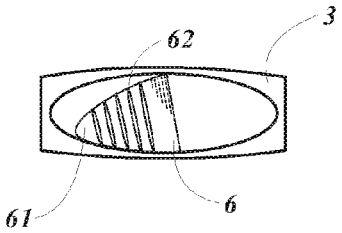
Figure 41C:
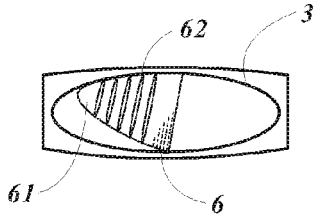
Figure 42:
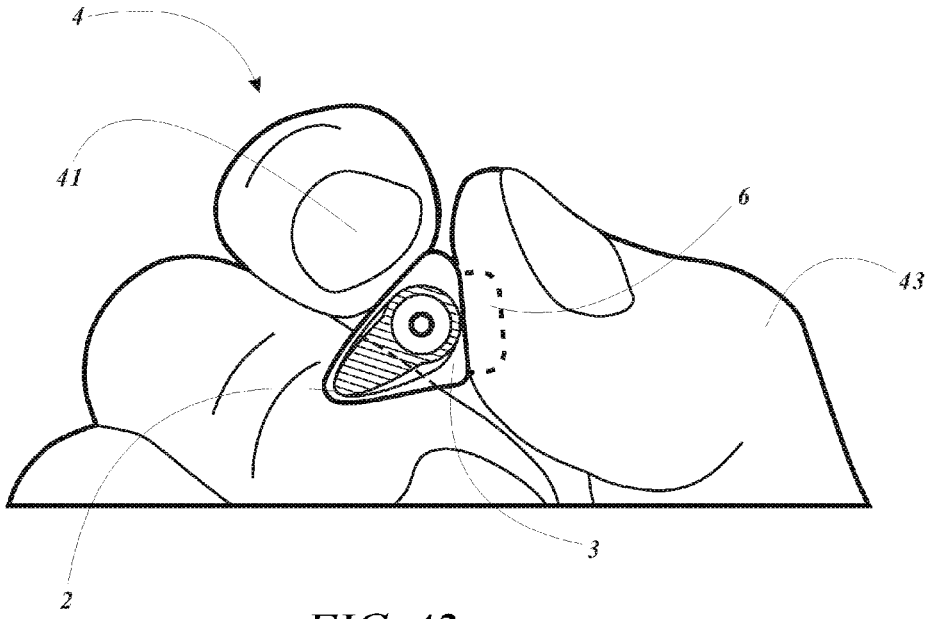
FIG. 42 is a schematic view illustrating the manipulation of the auxiliary stop protuberance.
Figure 43:
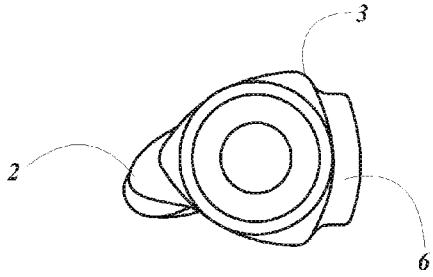
FIG. 43 is a front view of the auxiliary stop protuberance.
Figure 44:
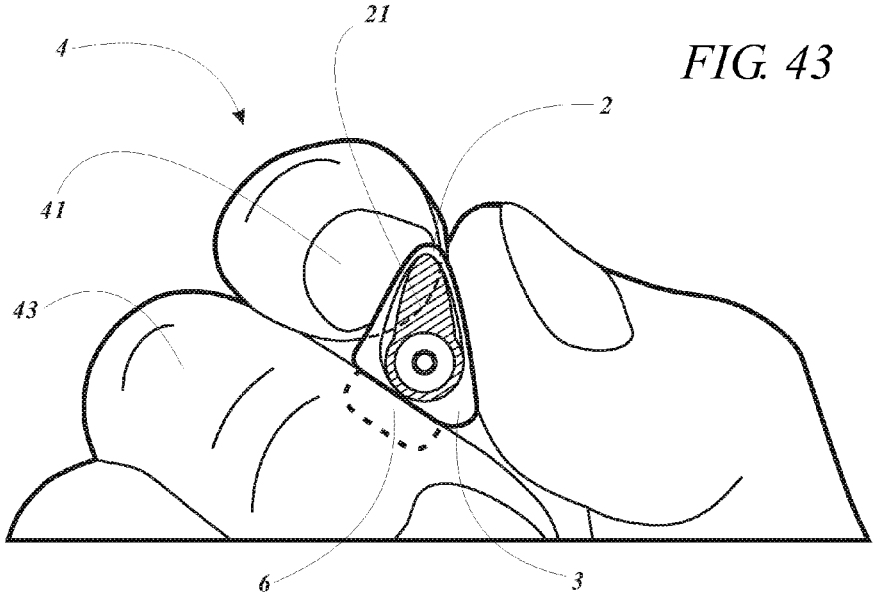
FIG. 44 is another schematic view illustrating the manipulation of the auxiliary stop protuberance.

As shown in FIG. 21A, FIG. 21E, FIG. 22A and FIG. 22E, the manipulation angle for the stop protuberance 2 is changed so as to allow using one of the fingers 4 as the specified finger 41 to lean against the stop protuberance 2 with its finger tip, finger face or finger back. For the finger 4 including a handicapped one, such as an index finger is handicapped or amputated below a handicapped line j1, it may be impossible to hold the penholder 1 in an ordinary manner; in this case, "clamping" is a solution to solve this problem as shown in FIG. 21B, FIG. 21C, FIG. 22B and FIG. 22C. For a small child whose fingers 4 have not grown strong enough, or a person with unhealthy fingers 4, a recommendable "holding" manner is shown in FIG. 21D and FIG. 22D. For some people who have severely handicapped index, middle or ring finger below a handicapped line j2, holding postures elucidated in FIG. 21E and FIG. 22F are preferable solutions. All the aforesaid manipulation manner should follow the feature provide by the stop protuberance 2 associated with the adjustable holding part 3; that is, leaning against the stop protuberance 2 with the specified finger 41 and allowing other fingers 4 to rest and be supported on the adjustable holding part 3. This way the user can be liberated from the demerit of "grasping" the penholder as that when using a conventional pen to write.

Referring to FIG. 23 through FIG. 34, for a fountain pen or the like one which has a defined direction in writing, lines scored by a writing end 11*a* of a penholder 1*a* are respectively different in onwards, sidewards and backwards directions. For this reason, a movable tube 12*a* is provided in the penholder 1*a* of the fountain pen, and the writing end 11*a* is formed ahead of the movable tube 12*a* such that the writing end 11*a* is turnable inside the penholder 1*a* along with the movable tube 12*a* thereby able to adjust an angle formed between the writing end 11*a* and the stop protuberance 2. The movable tube 12*a* is bonded with the penholder 1*a* with screw threads 13*a*, or may use an extra nipple 14*a* which being threaded on both interior and exterior surfaces to interconnect the movable tube 12*a* and the penholder 1*a* (see FIG. 28 and FIG. 29). With this structure, by loosening the screw threads 13*a* (see FIG. 30), the angles that the movable tube 12*a* and the writing end 11*a* formed between the stop protuberance 2 (see FIG. 31 and FIG. 32) can be adjusted at random, and then the writing end 11*a* can be settled at a proper position (see FIG. 32 and FIG. 33). The back of the middle finger can serve as the specified finger 41 to lean against the stop protuberance 2 with the other fingers 4 holding the adjustable holding part 3 from two sides to write, or holding the penholder 1*a* in an ordinary posture shown in FIG. 34.

The aforesaid manipulation manner for the specified finger 41 for holding the fountain pen is applicable to anyone of the directional penholders.

As shown in FIG. 35 through FIG. 38, a cap 5 may be used to protect the writing end 11*a*. The cap 5 should be made to match the appearance of the pen. For a fountain pen, the cap 5 should has a slot 51 formed inside to house the writing end 11*a*, besides, an coupling edge 52 should be formed on the fringe of the cap 5 to fix closely with the stop protuberance 2. A pen hook 53 is provided on the exterior surface of the cap 5 so as to hook the fountain pen or the like on the coat pocket to carry with.

Referring to FIG. 39 through FIG. 44, other than the stop protuberance 2, an auxiliary stop protuberance 6 may be formed at a proper position on the adjustable holding part 3. The auxiliary stop protuberance 6 has a tilted auxiliary rest surface 61 for the finger to lean against when writing. The configuration of the auxiliary rest surface 61 may be a flat or a slightly concaved plane varied in accordance with the condition of the user's hand. When holding the penholder 1, except leaning the specified finger 41 against the stop protuberance 2, another positioning finger 43 (as the thumb show in FIG. 40, 42, or the middle finger shown in FIG. 44) is rested on the rest surface 61 in the reverse direction at the same time thereby more reliably hold the adjustable holding part 3 upwards and downwards from two sides. Besides, the rest surface 61 is turnable about the axis of the penholder 1 to meet the user's holding posture, and slip resistant streaks 62 are formed on the auxiliary rest surface 61 so as to ensure supporting effect for the auxiliary positioning finger 43 (see FIG. 41A to FIG. 41C).

Figure 45:
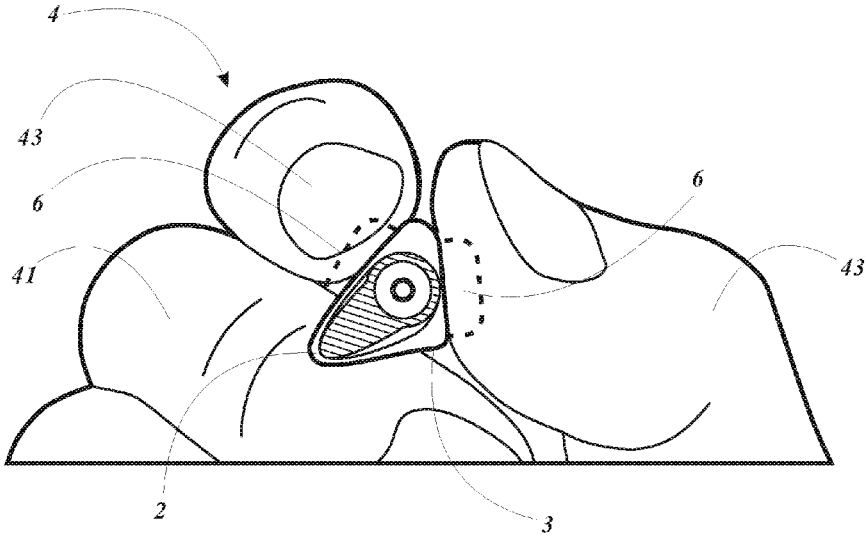
FIG. 45 is a schematic view illustrating the manipulation of the twin auxiliary stop protuberance.
Figure 46:
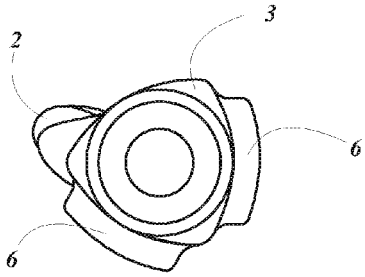
FIG. 46 is a front view of the twin auxiliary stop protuberance.
Figure 47:
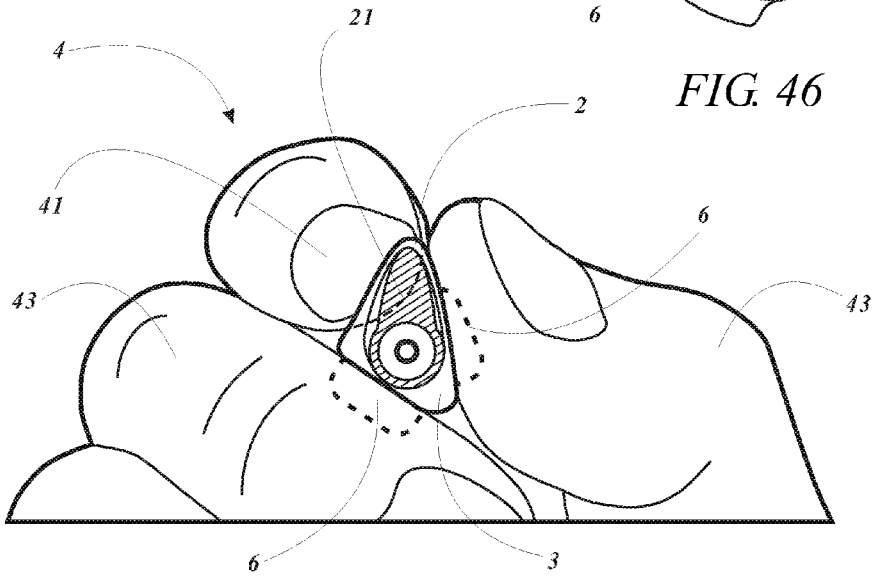
FIG. 47 is another schematic view illustrating the manipulation of the twin auxiliary stop protuberance.

Referring to FIG. 45 through FIG. 47, the auxiliary stop protuberance 6 may be made into a twin or a multiple shape. As shown in FIG. 45, the middle finger is the specified one 41 to lean against the stop protuberance 2; in addition, the thumb and the index fingers serve as two auxiliary positioning fingers 43 to commonly lean against the twin stop protuberance 6, or as shown in FIG. 47, in which the index finger is the specified one 41, and the thumb and the middle fingers serve as two auxiliary positioning fingers 43.

Although the description above contains many specificities, these should not be construed as limiting the scope of the invention but as merely providing illustration of some of the presently preferred embodiments of this invention. Thus the scope of the invention should be determined by the appended claims and their legal equivalents, rather than by the examples given.

What is claimed is:

1. A pen with adjustable holding structure comprising:

a penholder for holding and having a writing end at the front end thereof for writing;

a stop protuberance formed ahead of the holding position of said penholder for the user to lean against with a specified finger; and an adjustable holding part provided at the holding position of said penholder behind said stop protuberance, wherein said adjustable holding part is configured into a geometrically polygonal figure bendable in accordance with the user's manipulation habit so as to lead the user's finger to rest and settle on a proper location.

2. The pen of claim 1, wherein a supporting surface is formed behind said stop protuberance to assist the user's finger to rest and settle.

3. The pen of claim 2, wherein said supporting surface is in a flat or slightly recessed accurate plan shape and being capable of varying its shape according to the user's palm and manipulation habit.

4. The pen of claim 1, wherein said penholder is provided with a movable tube inside, and said writing end is formed ahead of said movable tube such that said writing end is turnable inside said penholder along with said movable tube and then fixed thereby adjusting a angle formed between said writing end and said stop protuberance.

5. The pen of claim 4, wherein the contact between said movable tube and said penholder is performed by screw threads so as to facilitate adjusting the angle therebetween and then fixed.

6. The pen of claim 1, wherein said adjustable holding part is in a triangular or polygonal geometrical shape for the convenience of manipulation in accordance with the user's hand condition.

7. The pen of claim 1, wherein said adjustable holding part is fabricated independent of said penholder, and then assembled with the latter.

8. The pen of claim 7, wherein said adjustable holding part is closely in contact with said stop protuberance with its front end by squeezing to form a curved leant surface convenient for holding.

9. The pen of claim 8, wherein said adjustable holding part has a rest surface at its front end for the user's finger to rest on and assisting manipulation of said penholder.

10. The pen of claim 1, wherein on said adjustable holding part, a guide end surface is being formed into different figures by bending and leading the fingers to a correct position to hold said penholder.

11. The pen of claim 10, wherein the edge of said guide end surface and curved surface of said adjustable holding part have a height difference reminding the user's fingers to settle at their respective positions.

12. The pen of claim 10, wherein the edge of said guide surface is provided with slip resistant streaks to ensure supporting and settling the fingers.

13. The pen of claim 1, wherein said adjustable holding part may have one or more than one auxiliary stop protuberance (twin or multiple stop protuberance).

14. The pen of claim 13, wherein said auxiliary stop protuberance has a tilted auxiliary rest surface for said specified finger to lean against when writing.

15. The pen of claim 14, wherein said rest surface is turnable about the axis of said penholder to meet the user's holding posture.

16. The pen of claim 14, wherein said auxiliary rest surface may be a flat or slightly concaved plane, or may vary its shape in accordance with the condition of the user's hand or manipulation habit.

17. The pen of claim 14, wherein said auxiliary rest surface has slip resistant streaks formed on it.

* * * * *